US006563465B2

(12) United States Patent
Frecska

(10) Patent No.: US 6,563,465 B2
(45) Date of Patent: May 13, 2003

(54) CEILING TILE ANTENNA AND METHOD FOR CONSTRUCTING SAME

(75) Inventor: Sandor A. Frecska, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 09/867,324

(22) Filed: May 29, 2001

(65) Prior Publication Data

US 2002/0180642 A1 Dec. 5, 2002

(51) Int. Cl.[7] ..... H01Q 1/38
(52) U.S. Cl. ..... 343/700 MS; 343/872
(58) Field of Search ..... 343/700 MS, 895, 343/907, 872, 873

(56) References Cited

U.S. PATENT DOCUMENTS

| | | | | |
|---|---|---|---|---|
| 4,330,691 A | | 5/1982 | Gordon | 179/146 |
| 4,367,474 A | * | 1/1983 | Schaubert et al. | 343/700 MS |
| 4,456,793 A | | 6/1984 | Baker et al. | 179/99 |
| 4,923,032 A | | 5/1990 | Nuernberger | 181/150 |
| 4,928,312 A | | 5/1990 | Hill | 381/192 |
| 4,941,207 A | * | 7/1990 | Maeda et al. | 455/617 |
| 5,316,254 A | | 5/1994 | McCartha | 248/343 |
| 5,516,068 A | | 5/1996 | Rice | 248/300 |
| 5,565,855 A | | 10/1996 | Knibbe | 340/825.06 |
| 5,619,217 A | | 4/1997 | Mailandt et al. | 343/872 |
| 5,742,895 A | | 4/1998 | Tanigawa et al. | 455/90 |
| 5,748,092 A | | 5/1998 | Arsenault et al. | 340/604 |
| 5,802,467 A | | 9/1998 | Salazar et al. | 455/420 |
| 5,936,593 A | * | 8/1999 | Mandai et al. | 343/895 |

FOREIGN PATENT DOCUMENTS

| | | | |
|---|---|---|---|
| GB | 2283642 | 5/1995 | H04B/1/03 |

* cited by examiner

*Primary Examiner*—Tan Ho
(74) *Attorney, Agent, or Firm*—Womble Carlyle Sandridge & Rice, PLLC

(57) ABSTRACT

A ceiling tile antenna for use in wireless local area networks and voice networks. A patch style antenna is manufactured in which the dielectric substrate is the ceiling tile itself, and the radiating element and the ground plane are fixed to the face and back of the tile, respectively. Since the ceiling tile acts as the antenna, the back of the ceiling tile does not have to be routed out to create a cavity for an antenna pod. The sizes of the radiating element and the ground plane are not an issue; therefore no miniaturization of the elements is required. Compared to microstrip antennas, a ceiling tile antenna provides a wider bandwidth and higher gain due to the thicker dielectric substrate used for the ceiling tile construction. Therefore, it is easier to achieve multiple resonances. The ceiling tile used as an antenna can be made from mineral fiber, medium density fiber board, fiberglass, drywall and polyvinyl chloride.

31 Claims, 2 Drawing Sheets

CEILING TILE ANTENNA AND METHOD FOR CONSTRUCTING SAME

CROSS-REFERENCE TO RELATED APPLICATION

This application is related to co-pending, commonly assigned patent application "Ceiling Tile Transmitter and Receiver System", Ser. No. 09/604,523, filed Jun. 27, 2000. The co-pending patent application is incorporated by reference into this description as fully as if here represented in full.

BACKGROUND OF THE INVENTION

This invention is related generally to wireless communications systems. More particularly, it is related to antennas for use with indoor wireless communications and voice networks.

Current indoor wireless solutions fasten antenna radomes to ceilings, walls, columns and the like. These solutions are aesthetically undesirable. There is a need for an indoor wireless antenna installation that is not visible. There is a need for a wireless solution that addresses both the wireless local area network (WLAN) and in-building voice network applications.

Commercial wireless communications systems use the radio frequency spectrum from 800 MHz to approximately 5 Ghz. Most such systems include a fixed, wired infrastructure and portable devices. The portable devices reach the infrastructure via access points or base stations. Current architecture of wireless systems such as a cellular telephone system includes a fixed portion of geographically-separated base stations and a number of remote communications devices. A base station has at least one transceiver that communicates with remote terminals by exchanging RF signals employing various formats and access techniques, such as frequency division multiple access (FDMA), time division multiple access (TDMA), code division multiple access (CDMA), etc. Communication channels are implemented by frequency modulating RF carrier signals near frequencies of 800 MHZ, 900 MHz, 1800 MHz and/or 1900 MHz. General aspects of cellular telephone systems are known in the art.

A wireless local area network is a flexible data communications system implemented as an extension or alternative to wired local area networks. Wireless LANs transmit and receive data over the air using radio frequency (RF) technology, minimizing the need for wired connections. Wireless LANs combine user mobility with data connectivity. The data being transmitted is superimposed on the RF carrier wave by frequency modulation. Multiple RF carrier waves can exist in the same space at the same time without interference if the RF carrier waves are transmitted on different frequencies.

In a typical wireless LAN configuration, a transmitter/receiver device, called an access point, connects to the wired network from a fixed location using standard cabling. A single access point can support a small group of users and can operate within a range up to several hundred feet. The access point or antenna attached to the access point is normally mounted high to obtain the desired transmission and reception coverage.

One type of WLAN network architecture is the "infrastructure" (IEEE 802.11b protocol standard). An 802.11b WLAN operates in the 2.4 Ghz band. This architecture uses fixed network access points with which mobile client devices can communicate. Access points hand off mobile client devices from one access point to another in a manner that is invisible to the mobile client device, providing unbroken connectivity. Wireless devices are equipped with a special network interface card (NIC) as well as an antenna, transceiver and circuitry to convert the analog RF signals into digital signals used by computers.

The distance over which RF waves can communicate is a function of transmitted power and receiver design, and the propagation path in indoor environments. Most wireless LANs use RF since RF waves can penetrate most indoor walls and obstacles. The range of coverage for wireless LANs can vary from less than a hundred to greater than 300 feet.

SUMMARY OF THE INVENTION

The present invention provides a method for constructing a patch style antenna in which the dielectric substrate is the ceiling tile (also referred to as ceiling panel) itself, and the radiating element and the ground plane are fixed to the face and back of the panel, respectively. Since the ceiling panel acts as the antenna, the back of the ceiling panel does not have to be routed out to create a cavity for the antenna pod, as is done currently. The sizes of the radiating element and the ground plane are not an issue; no miniaturization of the elements is required. The present invention provides a wider bandwidth and higher gain due to the thicker dielectric substrate used for the ceiling panel construction. Therefore, it is easier to achieve multiple resonances (i.e., multiple frequencies). The present invention also provides more freedom to design around various additional components.

A patch style antenna comprises four elements: the ground and radiating planes, the dielectric substrate separating the two, and connecting means such as a coaxial cable. The new element added by the present invention is the replacement of the typical thin plastic or epoxy material associated with microstrip antennas by a relatively thick substrate that already performs the primary function of serving as an acoustical ceiling panel. The acoustical ceiling panel has the dual function of providing an acoustical barrier and serving as a communications antenna at the same time. The acoustical ceiling panel becomes an active part of the antenna, rather than acting as a host for an embedded antenna.

The unique aspect of the invention is that the acoustical ceiling panel material itself serves as the dielectric substrate. This simplifies the manufacture and increases the design flexibility of antennas. Since the acoustical ceiling panel is the antenna, there is no need to attach discrete antennas to the acoustical ceiling panel as in the current method.

BRIEF DESCRIPTION OF THE DRAWINGS

The invention is better understood by reading the following detailed description of the invention in conjunction with the accompanying drawings, wherein.

DETAILED DESCRIPTION OF THE INVENTION

Figure 1:
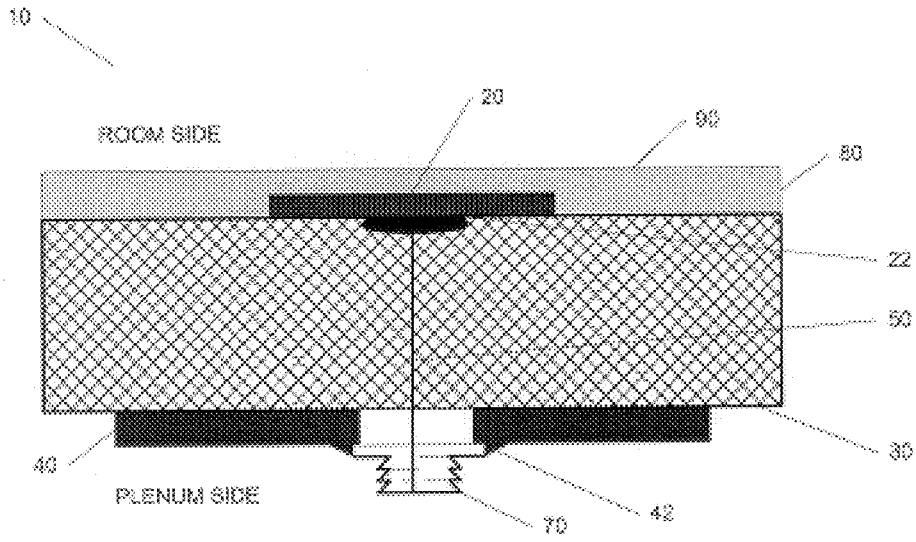
FIG. 1 illustrates a first embodiment of a ceiling tile antenna constructed in accordance with the present invention.

With reference to FIG. 1, a patch antenna 10 comprises a radiating metallic patch or plane 20 on one side of a dielectric substrate 30 that has a ground plane 40 on the other side. The planes or patches 20, 40 are conductors that are normally made of copper. The geometry of the patch 20, 40 can be virtually any shape, but conventional shapes are used to simplify analysis. The patches 20, 40 are affixed to the dielectric substrate. The substrate is usually non-magnetic. The dielectric constant k of the substrate should be low, typically less than 3. For communication purposes, the trend in microstrip patch antennas has been to use thin substrates on the order of 1 mm–2 mm, and as small as possible. The size scales as a function of frequency and the design of the antenna. At current cell phone and wireless local area network frequencies, the sizes of microstrip patch antennas range from approximately 2 inches to 6 inches in major dimension. However, there are designs where larger sizes and geometries, as well as thicker substrates, provide a better antenna design and functionality, i.e., a design that enhances radiation efficiency and increases bandwidth. Because of the trend toward miniaturization, these designs cannot be easily implemented, however, the present invention uses the ceiling tile (also referred to herein as ceiling panel) as the dielectric substrate. The radiating element 20 is fastened on the face of the tile 30. The radiating element 20 can be of any desired geometric shape, such as a rectangle, a triangle, etc., and as long as it is conductive, it can be glued, painted or printed on the face of the tile 30.

One possible radiating element is a logarithmic spiral antenna having a radiation pattern, impedance and polarization that remain unchanged over a bandwidth from 0.4 to 3.8 GHz that covers the cellular frequencies and IEEE 802.1b wireless LANs.

The ground plane 40, constructed from a metallic substrate, can be etched, glued, etc., to the back of the tile 30. The center conductor 50 of the coaxial cable is conductively fastened (solder or conductive joint 22) to the radiating element 20 through a hole in the tile 30. The ground lug 70 of the coaxial cable is conductively fastened (joint 42) to the ground plane 40. The elements are designed and located to provide the desired antenna characteristics.

In typical microstrip patch antennas, the dielectric substrate constant is in the range:

$$k=1 \text{ to } k=3$$

For typical ceiling board, k=1.31; some alternate ceiling materials such as foamed cement have a dielectric constant of k=1.8 making them also suitable for dielectric substrates for patch antennas. Likewise, medium density fiberboard having a k=2.6 is also suitable. To approximate the size of the radiating patch, the following expression can be used to compute the length L of the patch:

$$L \approx 0.49\lambda, \text{ where } \lambda = \text{wavelength.}$$

For an 800 MHz cell phone frequency, $\lambda$=36.8 cm, so L=18.032 cm. Normally such a large size antenna is undesirable, but if the ceiling tile 30 serves as the substrate, such a large size is acceptable.

Figure 2:
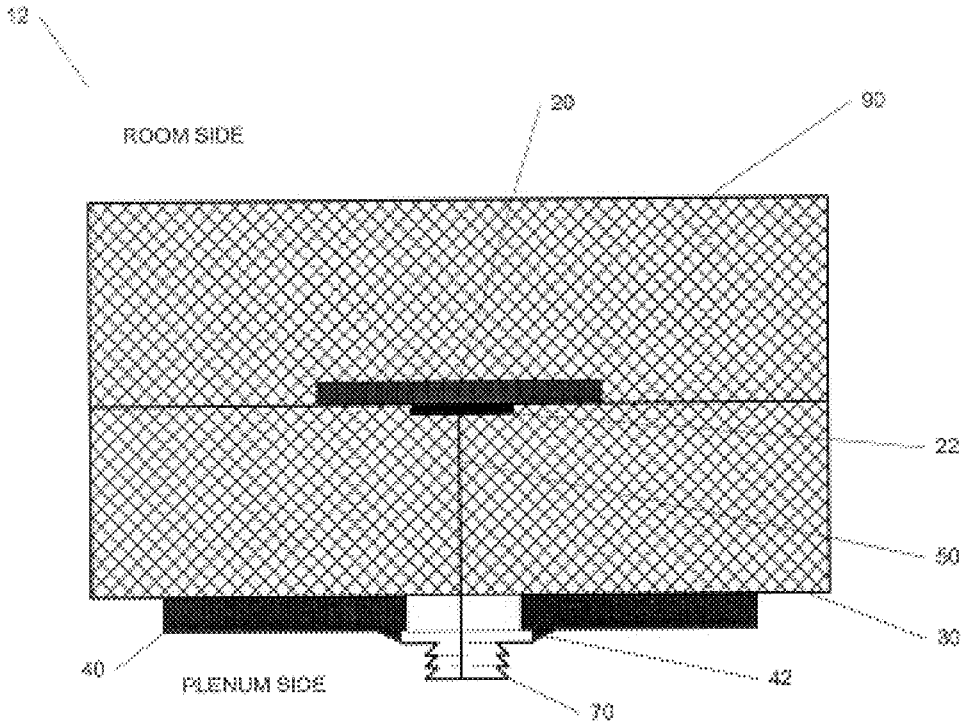
FIG. 2 illustrates a second embodiment of a ceiling tile antenna constructed in accordance with the present invention.

The usual thickness of the substrate in a microstrip patch antenna is on the order of 1–3 mm. A ceiling board substrate is on the average of 1.587 cm., entirely too thick for most applications. However, in the present invention, such thickness is acceptable since the ceiling board 30 serves both as the ceiling panel and the antenna substrate. The radiating plane 20, located on the surface of the tile 30 facing the interior of the room, can be covered with the same type of facing or scrim 80 currently used to achieve aesthetic appearance. If the scrim 80 cannot be used, a second layer of ceiling tile material 90 (see FIG. 2) can be used instead to cover the radiating element 20, effectively creating a stack configuration patch antenna 12, where the radiating element 20 is between two layers of tile material 30, 90. FIG. 2 illustrates this second embodiment of the invention.

Figure 3:
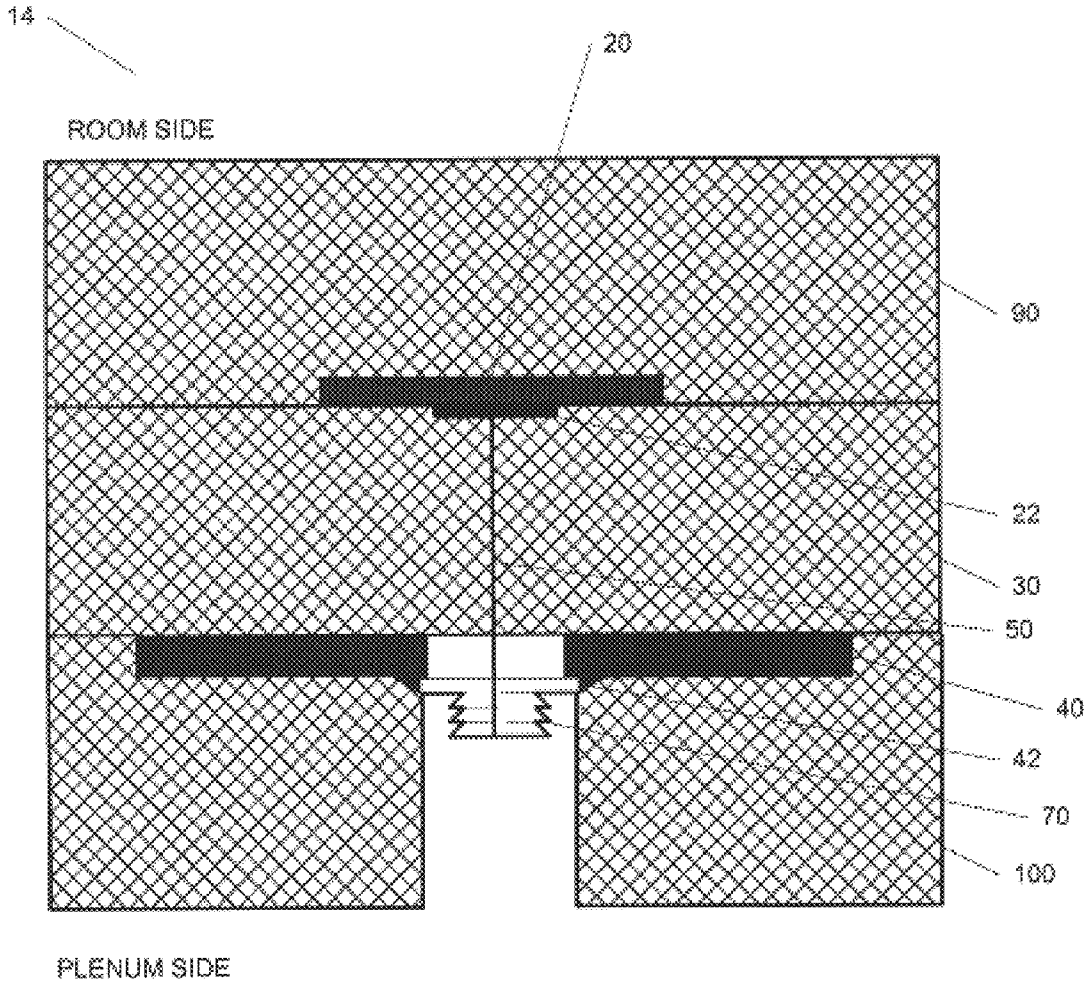
FIG. 3 illustrates a third embodiment of a ceiling tile antenna constructed in accordance with the present invention.

In a third embodiment of the invention, a second layer of ceiling tile material 90 can be used to cover the radiating element, and a third layer of ceiling tile material can be used to cover the ground plane 40 to create another stack configuration patch antenna. The radiating element 20 is between the two layers of tile material 30, 90 and the ground plane 40 is between the two layers of the material 30, 100. FIG. 3 illustrates this third embodiment of the invention.

The bandwidth of patch antennas is proportional to the thickness of the substrate used. The frequency bandwidth of such an antenna for an 800 MHz cell phone frequency using a ceiling tile as the substrate can be calculated from the following expression for bandwidth, where the bandwidth is in MHz:

$$BW = 4f^2\left(\frac{h}{1/32}\right),$$

where f is the operating frequency (GHz), and h is the thickness of the substrate (inches).

$$\text{Thus, } BW = 4(.8 \text{ GHz})^2\left(\frac{1.587/2.54}{1/32}\right) \approx 50 \text{ MHz}$$

Similarly, the bandwidth for a 2.4 GHz wireless local area network is approximately 460 MHz.

The method for manufacturing ceiling tile antennas is as follows:

1. after designing the appropriate radiating 20 and ground patches 40, the geometries can be die cut from thin copper sheets to maintain high accuracies;
2. the tile 30 is prepared by drilling a small hole where the conductor of the coaxial cable is passed through for attachment to the radiating element 20;
3. the conductor 50 of the coaxial cable is conductively fastened to the radiating element 20;
4. the radiating element 20 is glued or otherwise fastened to the front surface of the tile 30; and
5. the ground patch 40 has a hole in it through which the coaxial conductor 50 passes.

The hole must be large enough so the conductor 50 is insulated from the ground plane 40. The shielding of the coaxial cable is conductively attached to the ground patch 40, and the ground patch 40 is glued to the back side of the tile 30. The radiating 20 and ground planes 40 can be sprayed or printed on the tile 30. The ceiling tile 30 can be made from various materials including mineral fiber, medium density fiberboard, fiberglass, drywall (gypsum) and polyvinylchloride.

The ceiling tile antenna described herein can be incorporated into a wireless communication plane that provides an umbrella of connectivity for wireless and mobile client devices including cellular phones, personal digital assistants and wireless laptop computers. In addition to ceiling tile panels, the present inventive concept is applicable to wall panels and floor covering (floor panel) configurations. A floor panel antenna installation may be preferable in large indoor environments having very high ceilings. Although a typical ceiling tile installation would be in a ceiling grid structure that supported a plurality of identical ceiling panels made from materials such as mineral fiber or fiberglass, the present invention can also be used in a ceiling panel structure including a plurality of metallic panels such as can be found in the concourses of airports. In such an environment, the ceiling panel antenna can be manufactured as usual and then coated or sprayed with a material to blend in with the surrounding metallic panels.

Although the present invention has been described in the context of the manufacturing of ceiling tiles that affix the antenna radiating and ground planes after the manufacture of ceiling tiles, the invention is equally applicable to the installation of antenna radiating and ground patches to existing ceiling tiles. To that end, it is a simple extension to provide a retrofitting kit to building supply vendors, building contractors or directly to other parties that includes the tools and additional hardware and materials to rigidly affix the antenna elements to the external surfaces of existing ceiling tiles.

The corresponding structures, materials, acts, and equivalents of any means plus function elements in any claims below are intended to include any structure, material, or acts for performing the functions in combination with other claimed elements as specifically claimed.

While the invention has been particularly shown and described with reference to embodiments thereof, it will be understood by those skilled in the art that various changes in form and detail may be made without departing from the spirit and scope of the present invention.

What is claimed is:

1. An antenna for use in indoor communications systems comprising a radiating element, a ground element and a dielectric element, wherein the dielectric element is a ceiling panel comprising a material selected from the group consisting of mineral fiber, medium density fiber board, fiberglass, drywall and polyvinyl chloride.

2. The antenna of claim 1 wherein the radiating element and ground element are affixed to opposite surfaces of the dielectric element.

3. The antenna of claim 2 further comprising a second ceiling panel element mounted in a stack configuration with the first ceiling panel element to cover the radiating element.

4. The antenna of claim 3 wherein the second ceiling panel element comprises a material selected from the group consisting of mineral fiber, medium density fiberboard, fiberglass, drywall and polyvinyl chloride.

5. The antenna of claim 2 further comprising a second ceiling panel element mounted in a stack configuration with the first ceiling panel element to cover the ground element.

6. The antenna of claim 5 wherein the second ceiling panel element comprises a material selected from the group consisting of mineral fiber, medium density fiberboard, fiberglass, drywall and polyvinyl chloride.

7. The antenna of claim 2 further compromising a second ceiling panel element mounted in a stack configuration with the first ceiling panel element to cover the radiating element and a third ceiling panel element mounted in a stack configuration with the first ceiling panel element to cover the ground element.

8. The antenna of claim 7 wherein the second ceiling panel element and third ceiling panel element comprise a material selected from the group consisting of mineral fiber, medium density fiberboard, fiberglass, drywall and polyvinyl chloride.

9. The antenna of claim 1 wherein the radiating element is affixed to the surface of the ceiling panel facing into a defined workplace area.

10. The antenna of claim 1 further comprising a conducting element fastened to the radiating element through a hole penetrating through the ceiling panel.

11. The antenna of claim 1 further comprising a facing element to cover the radiating element.

12. The antenna of claim 11 wherein the facing element is a scrim.

13. The antenna of claim 1 wherein the indoor communication systems operate in the radio frequency spectrum from 800 MHz to 5 GHz.

14. An antenna for use in indoor communications systems comprising a radiating element, a ground element and a dielectric element, the dielectric element comprising a material selected from the group consisting of mineral fiber, medium density fiber board, fiberglass, drywall and polyvinyl chloride wherein the radiating element and ground element are affixed to opposite surfaces of a floor covering.

15. An antenna for use in indoor communications systems comprising a radiating element, a ground element and a dielectric element, the dielectric element comprising a material selected from the group consisting of mineral fiber, medium density fiber board, fiberglass, drywall and polyvinyl chloride wherein the radiating element and ground element are affixed to opposite surfaces of a wall panel.

16. An antenna for use in indoor communications systems comprising a radiating element, a ground element and a dielectric element wherein the dielectric element is a ceiling panel.

17. The antenna of claim 16 wherein the dielectric element comprises a material selected from the group consisting of mineral fiber, medium density fiberboard, fiberglass, drywall and polyvinyl chloride.

18. The antenna of claim 16 wherein the radiating element and ground element are affixed to opposite surfaces of the ceiling panel.

19. The antenna of claim 16 further comprising a conducting element fastened to the radiating element through a hole penetrating through the ceiling panel.

20. The antenna of claim 16 further comprising a scrim to cover the radiating element on a surface of the ceiling panel.

21. The antenna of claim 16 wherein the indoor communications system operates in the radio frequency spectrum from 800 MHz to 5 GHz.

22. A method for manufacturing a ceiling panel antenna for an indoor communications system, comprising the steps of:

determining a geometric shape for each of a radiating patch and a ground patch based on an operating bandwidth of the indoor communications system;

forming the determined geometric shapes from conductive sheets;

forming a small hole through a ceiling panel for passing a conductor of a coaxial cable through the ceiling panel to the radiating patch;

attaching the radiating patch to a front surface of the ceiling panel;

conductively fastening the conductor to the radiating patch;

attaching the ground patch to a back surface of the ceiling panel; and conductively attaching a shielding of the coaxial cable to the ground patch.

23. The method for manufacturing a ceiling panel antenna of claim 22 wherein the ground patch is glued to the back surface of the ceiling panel.

24. The method for manufacturing a ceiling panel antenna of claim 22 wherein the radiating patch is glued to the front surface of the ceiling panel.

25. The method for manufacturing a ceiling panel antenna of claim 22 wherein the radiating patch is sprayed or printed on the front surface of the ceiling panel.

26. The method for manufacturing a ceiling panel antenna of claim 22 wherein the ground patch is sprayed or printed on the back surface of the ceiling panel.

27. The method for manufacturing a ceiling panel antenna of claim 22 wherein the ceiling panel comprises a material selected from the group consisting of mineral fiber, medium density fiber board, fiberglass, drywall and polyvinyl chloride.

28. The method for manufacturing a ceiling panel antenna of claim 22 further comprising passing the coaxial cable through a hole in the ground patch.

29. An antenna for use in indoor communications systems comprising a radiating element, a ground element and a dielectric element, wherein the dielectric element is an acoustical ceiling panel comprising a material selected from the group consisting of mineral fiber, medium density fiber board, fiberglass, drywall and polyvinyl chloride.

30. An antenna for use in indoor communications systems comprising a radiating element, a ground element and a dielectric element, wherein the dielectric element is an acoustical wall panel comprising a material selected from the group consisting of mineral fiber, medium density fiber board, fiberglass, drywall and polyvinyl chloride.

31. An antenna for use in indoor communications systems comprising a radiating element, a ground element and dielectric element, wherein the dielectric element is an acoustical floor panel comprising a material selected from the group consisting of mineral fiber, medium density fiber board, fiberglass, drywall and polyvinyl chloride.

* * * * *